US005631437A

United States Patent [19]

LaVigna et al.

[11] Patent Number: 5,631,437

[45] Date of Patent: May 20, 1997

[54] GUN MUZZLE CONTROL SYSTEM USING BARREL MOUNTED ACTUATOR ASSEMBLY

[75] Inventors: Christopher LaVigna, Olney, Md.; Gilmer Blankenship, Washington, D.C.; Harry Kwatny, Elkins, Pa.

[73] Assignee: Techno-Sciences, Inc., Lanham, Md.

[21] Appl. No.: 671,732

[22] Filed: Jun. 28, 1996

[51] Int. Cl.[6] ..... F41A 21/36; F41A 25/00

[52] U.S. Cl. ..... 89/14.3; 89/14.05; 89/41.03; 89/41.02; 89/41.16

[58] Field of Search ..... 89/14.05, 14.3, 89/41.02, 41.03; 42/76.01–79

[56] References Cited

U.S. PATENT DOCUMENTS

| | | | |
|---|---|---|---|
| 202 | 3/1837 | Geeter | 89/14.05 |
| 342 | 10/1837 | Geeter | 89/14.05 |
| 4,480,524 | 11/1984 | Bloomqvist et al. | 89/41.16 |
| 4,558,627 | 12/1985 | LeBlanc et al. | 89/41.02 |
| 5,413,029 | 5/1995 | Gent et al. | 89/41.03 |
| 5,520,085 | 5/1996 | Ng et al. | 89/41.03 |

FOREIGN PATENT DOCUMENTS

| | | | |
|---|---|---|---|
| 2111656 | 7/1983 | United Kingdom | 89/14.05 |

*Primary Examiner*—Michael J. Carone
*Assistant Examiner*—Matthew J. Lattig
*Attorney, Agent, or Firm*—Christopher N. Sears

[57] ABSTRACT

The present invention pertains to a device for precision aim control of a gun barrel muzzle of a turreted gun system for improved projectile accuracy of fired projectiles. Improved projectile accuracy is defined as minimizing the distance between a projectile's point of impact and the point of aim thereof. The invention includes an actuator assembly mounted to a flexible gun barrel that act in combination with elevation and azimuth actuators located in the gun's turret. The device also includes a muzzle sensory feedback subsystem for continuous sensing of the gun muzzle's i) displacement, ii) azimuth and iii) elevation angles as the gun is fired. The barrel mounted actuator assembly along with the muzzle sensory feedback subsystem significantly improves the muzzle's aim performance. The invention comprises several components that include: i) one or more barrel mounted actuator assemblies that has one or more longitudinal mounted barrel actuator element(s) for applying bending torques to a gun barrel; ii) a muzzle sensory feedback subsystem for continuous measuring of linear and/or angular displacement of a gun muzzle; iii) a turret mounted actuator for providing torques and/or forces to aim the gun muzzle; iv) a turret mounted sensor system to measure the azimuth and elevation angles generated by the turret mounted actuator subsystem; and v) a feedback control system for processing commands from input and feedback signals from turret mounted sensors and muzzle sensors and producing output commands to the barrel actuator assembly and the gun turret aim actuators.

15 Claims, 3 Drawing Sheets

GUN MUZZLE CONTROL SYSTEM USING BARREL MOUNTED ACTUATOR ASSEMBLY

FIELD OF THE INVENTION

The invention pertains in general to gun aiming systems and in particular to an improved gun barrel bending actuator assembly in combination with a gun's turret control system for increased gun target accuracy and/or aim.

BACKGROUND OF THE INVENTION

U.S. Statutory Invention Registrations (SIR) H202 and H342 by Geeter entitled "Barrel Flexure Control System" & "Apparatus to Improve Accuracy of guns Through Barrel Flexure" both teach of gun barrel moment generating components in combination with either an open-loop or very crude closed-loop control devices for control of a gun's barrel flexure. The (SIR) H202 teaches of two actuator elements in quadrature with fluidic piston control device attached to the gun barrel at a fulcrum position that additionally includes linear voltage differential transformers for positional feedback signals for control of these actuators. The (SIR) H342 teaches of the same two actuator elements with fluidic piston control attached at a fulcrum position of the gun barrel with an additional feature components that direct the flow of hot gases from the gun barrel for controlling barrel flexure. The SIR H342 is a continuation-in-part of Geeter's earlier SIR H202 with more information regarding the earlier device's performance and that the actuators used for barrel flexure can be either electrical, mechanical in construction.

Limitations of these two SIRs compared with the instant invention include Geeter's use of a bearing based structural member for attachment of the fulcrum members to a gun barrel with actuators that act directly on the gun barrel. The instant invention uses actuators that act on the bracket members rigidly attached to a gun barrel. This feature allows for better flexure controllability with greater bandwidth capability since the instant invention's bracket design is more rigid for a given mass for various calibered guns along with being lighter and more compact. This factor is significant when designing large diameter barrels since bending large diameter gun barrels requires comparable large forces. The outer cylindrical protective structure of Geeter's flexure control assembly would be much larger and heavier for a required rigidity to enable efficient transfer of energy from the actuator to the barrel. Next, an increase in the gun barrel's actuator capacity using the instant invention requires comparatively less of an increase in the supporting bracket's size to satisfy geometrical and durability design constraints. Finally, Geeter's devices do not use muzzle sensory feedback for controlling the actuators in combination with a gun turret control as in the instant invention.

Geeter's preferred open-loop control scheme of actuator commands is determined using standard calibration tests performed by ten shots fired from a candidate gun system where the impact location of each shot is measured. Using these data, a standard mean barrel bending actuator command is determined to counteract the muzzle's motion for minimizing distance between a projectile impact and the point of aim for each shot fired. These averaged commands are used to drive the bending actuator whenever the gun is fired. Geeter's design provides no measurement of a muzzle's deflection during gun firing as required by the instant invention for more accurate firing of the gun. Next, Geeter's preferred open-loop control scheme is very problematic since: i) the actuator command signals are determined experimentally based on a series of test firings and ii) there is no sensory feedback of muzzle displacement which inherently makes the gun sensitive to variations in physical parameters in which it operates. These parameters include: barrel temperature, differences in ammunition used from one round to the next, number of rounds fired in a short duration, gun orientation and actual physical condition of the gun system. In contrast, the instant invention described herein uses feedback control to directly measure and regulate the muzzle orientation resulting in precise directional control of an exiting projectile. Also, when using closed-loop muzzle deflection feedback control, compensation can be built into the device for variations as described above.

The instant invention's gun barrel flexure actuator assembly additionally compensates for i) barrel droop, ii) barrel whip and iii) platform motions. These three phenomenon effects are minimized by the invention's muzzle sensory feedback subsystem, a feature not taught or suggested by the Geeter's devices. In particular, barrel droop is a physical phenomenon occurring in long gun barrel systems such as tanks and artillery pieces that deflect significantly in response to increased gun barrel temperature caused by either repeated gun firing or exposure to intense sunlight. Barrel whip is a phenomenon in which the barrel muzzle displaces or whips violently as the projectile travels inside the barrel from the breach towards the muzzle. Both of these physical phenomenon cannot be compensated for since there is no feedback element in Geeter's muzzle design. Finally, Geeter's invention cannot compensate for the affects of platform motion on muzzle displacement. Geeter's open-loop control scheme is calibrated upon firing groups of 10 test rounds and measuring the distances of each round from the aim point assuming a rigid base. If a gun's mounting base experiences random motion, Geeter's calibration data are incorrect and the accuracy of the gun is suspect. Accordingly, the present invention is an improvement over the current state of the art in barrel flexure techniques for accurate aim and targeting of a projectile.

SUMMARY OF THE INVENTION

The present invention pertains to a device for precision aim control of a gun barrel muzzle of a turreted gun system for improved projectile accuracy of fired projectiles. Improved projectile accuracy is defined as minimizing the distance between a projectile's point of impact and the point of aim thereof. The invention includes an actuator assembly mounted to a flexible gun barrel that act in combination with elevation and azimuth actuators located in the gun's turret. The device also includes a muzzle sensory feedback subsystem for continuous sensing of the gun muzzle's i) displacement, ii) azimuth and iii) elevation angles as the gun is fired. The barrel mounted actuator assembly along with the muzzle sensory feedback subsystem significantly improves the muzzle's aim performance. The invention comprises several components that include: i) one or more barrel mounted actuator assemblies that has one or more longitudinal mounted barrel actuator element(s) for applying bending torques to a gun barrel; ii) a muzzle sensory feedback subsystem for continuous measuring of linear and/or angular displacement of a gun muzzle; iii) a turret mounted actuator for providing torques and/or forces to aim the gun muzzle; iv) a turret mounted sensor system to measure the azimuth and elevation angles generated by the turret mounted actuator subsystem; and v) a feedback control system for processing commands from input and feedback signals from turret mounted sensors and muzzle sensors and producing output commands to the barrel actuator assembly and the gun turret aim actuators.

Accordingly, several objects of the present invention are:

(a) To provide a gun barrel flexure actuator assembly with muzzle sensory feedback in a turreted gun system for accurate aim of a projectile.

(b) To provide a gun barrel flexure actuator assembly in a turreted gun system with muzzle sensory subsystem that continuously senses a muzzle's i) displacement, ii) azimuth and iii) elevation angles as the gun is fired to compensate for i) barrel droop, ii) barrel whip and iii) platform motions.

(c) To provide a gun barrel flexure actuator assembly with improved bracket attachment to a gun barrel as part of the bending actuator assembly allowing for greater controllability with greater bandwidth capability; and (d) To provide a gun barrel flexure actuator assembly that is more compact and less massive in design.

Still further advantages will become apparent from consideration of the ensuing detailed description.

DETAILED DESCRIPTION

Figure 1:
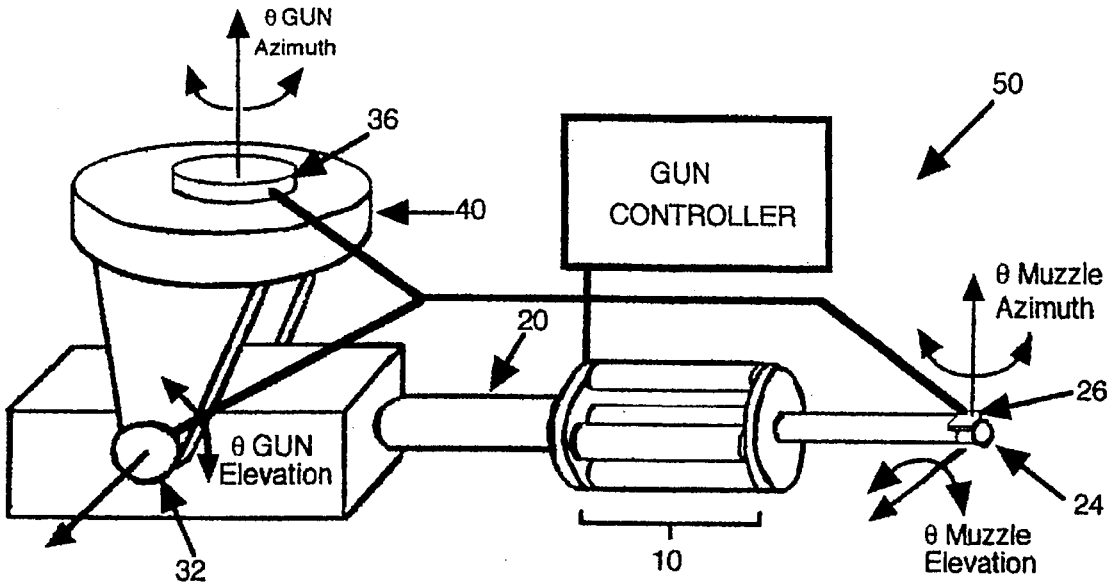
FIG. 1 shows a profile view of a turreted gun system with gun barrel bending actuator assembly and the muzzle sensory feedback sensors.

FIG. 1 shows a perspective view of a typical turreted gun assembly 50. The invention comprises a barrel mounted bending actuator assembly 10, a muzzle sensory subsystem 26, a turret azimuth 36 and elevation actuators 32 with associated turret azimuth and elevation sensors, and a preferred closed-loop feedback control system for improved muzzle aiming performance.

The barrel mounted bending actuator assembly 10 is designed to apply torques to the gun barrel 20 based on input commands received from the feedback control system. FIG.'s 2 and 3 show cross-sectional and frontal views of the barrel mounted actuators 10. The design of the bending actuator assembly 10 enables the production of two counteracting pairs of torques about axes that are orthogonal, thereby enabling very precise bending response of the gun barrel 20 in two orthogonal planes. The bending actuator assembly 10 is composed of several components:

Actuator element(s) 12: The assembly 10 is configured with at least three active elements 12 that generate axial forces aligned with the gun barrel that are transmitted through mounting brackets 14 to the gun barrel 20. They are configured such that their axes are aligned parallel and symmetrical to the gun barrel axis with permissible offset in the radial direction. The connections of the active elements to the brackets 14 are designed so that only axial forces are transmitted to and from the actuator element(s) 12 to brackets 14. The actuator element(s) 12 can be made from either piezo-ceramic or magnetostrictive materials with appropriate electrical connections or be a pneumatic or hydraulic piston actuation device.

Mounting brackets 14: The active element(s) 12 are attached to the gun barrel 15 using at least one set of mounting brackets 14. The brackets 14 are attached to the gun barrel 20 using either a clamping device, epoxied, welded or be an integral machined part of the gun barrel 20. Their design must be significantly stiffer than the gun barrel 20 so that forces generated by actuator element(s) 12 are transmitted efficiently to the barrel 20. The actuator assembly 10 uses the mounting brackets 14 to attach the actuator element(s) 12 to the barrel 20 and transmit the axial forces to the barrel 20 as bending moments. The design of these brackets 14 is critical for efficient and reliable mechanical operation of the actuator assembly 10. The efficient mechanical transfer of the axial forces is directly related to the stiffness of the brackets relative to the stiffness of the gun barrel. This requires that the bracket stiffness be much greater than the barrel stiffness. In addition to mechanical efficiency, the design of the brackets affects the reliability as well. Since the actuator element(s) 12 are typically made from brittle material, it is important to minimize any loads that could create tensile stresses in this material.

Energy source: An energy source is required to drive the actuator element(s) 12. The type of energy source depends on the type of actuator element(s) 12 used. For example, a voltage amplifier is used as the energy source for a piezoceramic based actuation element, a current amplifier is used for a magnetostrictive actuation element, and a fluid motor is used for either a hydraulic or pneumatic actuation piston element.

Displacement control subsystem (DCS): Each bending actuator element (12) is configured with the DCS for precise displacement control of the actuator element(s) 12. The DCS uses closed loop feedback of each actuator element displacement as part of assembly 10. The DCS is designed to linearize the response of assembly 10 from the desired input voltage command to the output torques delivered to the barrel via the mounting brackets independent of the operation of the overall system feedback controller of the gun 50. The DCS delivers two pairs of torque couples in orthogonal planes to the gun barrel 20 that are proportional to this input voltage command. Under open loop control conditions, the linearity of assembly 10 would be dependent on the linearity of actuator elements 12. For piezoceramic and magnetostrictive material based actuators 12, there are significant nonlinear effects such as hysteresis and creep that are minimized by using the DCS. The displacement control system measures expansion or contraction of the ends of actuator element(s) 12 and generate commands to the energy source based on an input command to the actuator assembly 10 from the feedback control system. The DCS linearizes the actuator element(s) 12 dynamics within acceptable performance limits to provide a flat frequency response of this command torque. The assembly 10 can operate without the DCS in operation, but results in performance degradation.

Figure 5:
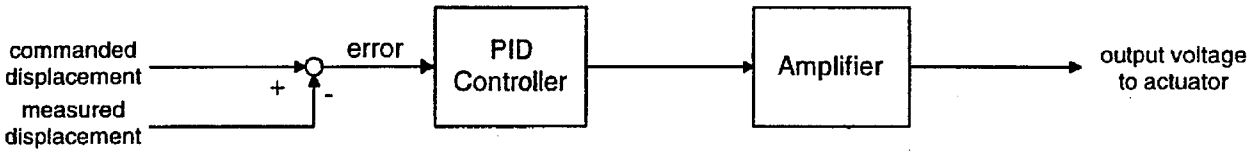
FIG. 5 shows a signal flow diagram of the gun system's displacement control subsystem.

The DCS of assembly 10 can be an analog proportional-integral-derivative (PID) circuit based controller, as shown in FIG. 5. The displacement of the actuator is measured and subtracted from the commanded displacement to produce an error signal. This error signal is passed through a typical PID circuit using analog based components. An output signal is amplified to generate an output signal to drive the actuator element 12. This circuit was designed to produce a linear input/output response for an appropriate bandwidth of a particular gun design.

Figure 2:
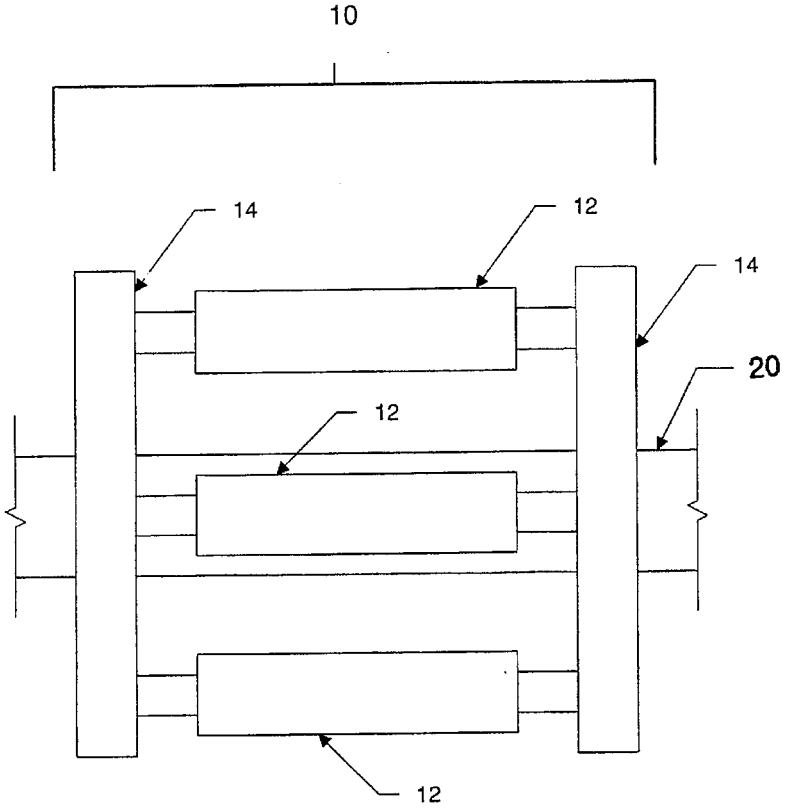
FIG. 2 shows a cross-sectional A—A view of the barrel bending actuator assembly.
Figure 3:
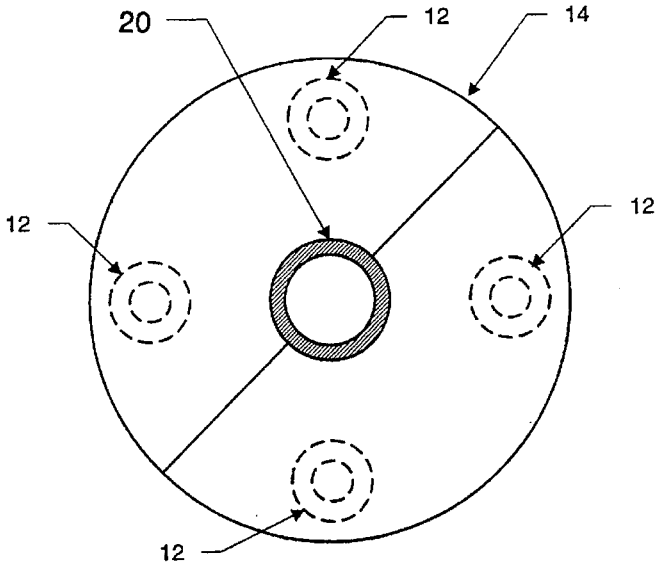
FIG. 3 shows a frontal-sectional view with respect to the A—A view of FIG. 2 of the barrel bending actuator assembly.

As an example FIGS. 2 and 3 show actuator element(s) 12 that are four elements that produce axial forces on the brackets 14. The bending actuator assembly 10 can use four strain gage sensors to measure the expansion and contraction of the actuator element(s) 12 for the displacement control subsystem. The bending actuator assembly 10 can use a four channel position servo control module for controlling the displacement of the actuator element(s) 12. This servo control module linearizes the displacement versus input voltage response of the actuator element(s) 12. It also compensates for nonlinear effects of the element(s) 12 caused by hysteresis and inherent mechanical tolerances caused by the element(s) 12 to bracket 14 interface. The bending actuator assembly 10 can use a two channel power amplifier to drive the element(s) 12. Each amplifier is used to drive a pair of element(s) 12 spaced 180 degrees apart from each other using voltage commands that are out of phase. The four element(s) 12 are grouped into two channels comprising corresponding pairs of element(s) 12. By sending a positive voltage signal to one element 12 of the pair and a negative voltage to the other element in the pair, a rapid bending moment is generated at the mounting bracket. Dual channels usage allows for bending moments about two orthogonal axes.

Muzzle sensory subsystem (MSS): The muzzle sensors 26 are designed to measure both linear and/or angular displacement of the muzzle 24 continuously as the muzzle 24 displaces in response to firing and external disturbances. These sensors 26 can be either accelerometers, optical based sensor devices using laser, mirror and laser detectors, or fiber optic strain sensors with means for detecting angular or linear displacement. The muzzle sensor subsystem bandwidth depends on the values of the natural frequencies inherent in the gun system and the gun system firing rate. Gun systems with high firing rates and high natural frequencies, e.g. small bore automatic guns, require sensing systems having sufficient bandwidth to measure muzzle deflections at high frequencies. Conversely, guns systems with low firing rates and low natural frequencies, e.g. tanks and artillery pieces, require relatively less bandwidth capability. Sensors for the MSS for measuring the muzzle linear and/or angular displacement include accelerometer and optical based sensors.

i) An accelerometer based sensor system measures the muzzle displacement and/or angular orientation (i.e. azimuth and elevation angles) and is attached to a gun barrel near the muzzle using either a machined surface on the barrel or a bracket device attached to the barrel. The bracket device would be attached to the barrel by clamping force, welding, epoxy, etc. so that a positive attachment of the bracket to the barrel was obtained. The accelerometers would be attached to the clamp using a standard threaded stud configuration.

ii) An optical based system to measure the angular orientation of the muzzle relative to a reference frame fixed in 40 would have the following configurations. A first configuration would include the major components of a laser source mounted to gun turret 50, a mirror mounted near the gun barrel muzzle 24, a laser detector mounted to gun turret 50 in near proximity to the laser, and analog electronic circuits to process the output signals of the laser detector. The system operates by aiming the laser source at a mirror and the reflected beam impinges on a surface of the laser detector. The laser detector produces two voltages each of which is proportional to the x and y positions of the impinging laser spot respectively. As the barrel flexes, the mirror mounted at the muzzle exhibits angular displacement which causes the reflected laser beam to move generating a corresponding motion of the spot on the detector surface. The angular displacement of the mirror and therefore the muzzle is proportional to the displacement of the spot on the laser detector. This displacement is obtained by measuring the voltages of the detector outputs. A second configuration would include an optical fiber displacement sensor that can measure both angular and linear motion of the muzzle 24. In this configuration at least two distinct independent sensors are attached to the barrel 20 orthogonally along its length.

Turret azimuth and elevation actuation systems: These systems provide torques that enable a gun system's muzzle to move in azimuth and elevation. They are mounted to the turret and can be electrical, hydraulic, pneumatic or devices that produce torques or forces with sufficient magnitude and bandwidth that satisfy response requirements.

Turret azimuth and elevation sensors: These sensors provide continuous measurements of the azimuth and elevation angles of the gun system, and are typically optical disk encoders or angular resolvers. The azimuth sensor is usually mounted at or near the azimuth actuator 36 and the elevation sensor is usually at or near the elevation actuator 32.

The turret azimuth and elevation actuation systems, turret azimuth and elevation sensors and portions of the feedback control system are well known in the art as illustrated by U.S. Pat. No. 4,558,627 entitled "Weapon Control System" or U.S. Pat. No. 4,480,524 entitled "Means for Reducing Gun Firing Dispersion" which are hereby incorporated by reference for illustration.

Figure 4:
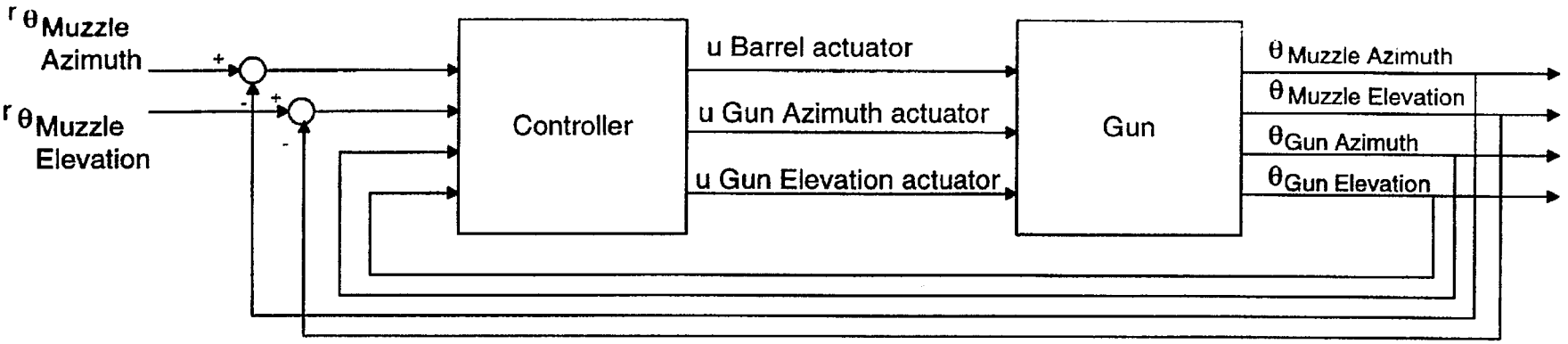
FIG. 4 shows a signal flow diagram of the gun system's feedback controller.

Feedback control system (FCS): FIG. 4 illustrates the feedback control system that processes the muzzle sensor data and the turret azimuth and elevation sensor data to generate actuation commands to the turret azimuth and elevation actuators and barrel mounted actuator to precisely point the gun muzzle according to desired muzzle azimuth and elevation reference commands. The input-output response of the FCS is dependent on the type of FCS control method used. These methods include linear and nonlinear based designs. The linear designs include linear quadratic Gaussian/loop transfer recovery (LQG/LTR), disturbance accommodation, and $H\infty$ (H-infinity) controllers. The nonlinear designs include partial feedback linearization (PFL) and adaptive PFL based controllers.

Moreover, the FCS of the instant invention can be adapted to incorporate adaptive control methodologies in the FCS to further improve aim performance. Such methodology is illustrated in U.S. Pat. No. 5,413,029 entitled "System and Method for Improved Gun Systems Using a Kalman Filter," which is incorporated by reference. This teaching use a doppler radar muzzle velocity detection device attached to the gun barrel to measure the muzzle velocity of shells as they are fired, see FIG. 3 therein. In particular, this Doppler based radar system with projectile velocity prediction scheme that measures projectile velocity can be used as another sensor system interfaced to the FCS described herein. This provides actual measurements of a projectile's velocity in which the FCS herein is controlling. The projectile velocity prediction scheme of the U.S. Pat. No. 5,413,029 can be an independent control methodology of the FCS. The performance of the U.S. Pat. No. 5,413,029 methodology is enhanced by the presence of the barrel mounted actuator assembly 10 which allows for better control of the gun system 50 dynamics.

Typically, the accelerometer and optical based sensor systems of the MSS contain measuring components that produce analog voltage signals that are linearly proportional to the measured variable (i.e. muzzle acceleration for the accelerometer based system or muzzle angular orientation for the optical based system). These analog signals are interfaced to the FCS via digital hardware. The FCS uses a digital based PC computer using digital signal processing (DSP) hardware. The FCS controller methods that generate outputs to drive the actuators elements 12 input signals from the MSS sensory signals typically use differential equations that are solved by the digital hardware in real time. Analog-to-digital (A/D) converter hardware convert the analog sensor signals from the sensor subsystem 26 and the turret azimuth and elevation sensors to digital input signals for use by the feedback controller hardware. Digital-to-analog (D/A) converter hardware is used to convert the digital output signals from the FCS into analog voltage signals to drive the actuators 10, 36 and 32.

While this invention has been described in terms of a preferred embodiment, it is understood that it is capable of further modification and adaptation of the invention following in general the principle of the invention and including such departures from the present disclosure as come within the known or customary practice in the art to which the invention pertains and may be applied to the central features set forth, and fall within the scope of the invention and the appended claims.

We claim:

1. An apparatus for precision aim of a gun with a gun barrel having a longitudinal axis for firing a projectile comprising:

at least one bending actuator assembly wherein each assembly includes:

a first bracket member rigidly affixed to the gun barrel and for acting as a first fulcrum for bending the gun barrel;

a second bracket member rigidly affixed to the gun barrel at a location spaced along the longitudinal axis from the first bracket and for acting as a second fulcrum for flexing the barrel;

an actuator means connected between the first and second brackets for applying a force between the first and second brackets for generation of a bending moment in the gun barrel, and a muzzle sensory means attached at a muzzle portion of the gun for continuous sensing of the muzzle's i) displacement, ii) azimuth and iii) elevation angles; signals from the muzzle sensory means are connected to a feedback controller means for functions including control of the actuator assembly thereby compensating for the gun's i) barrel droop, ii) barrel whip, and iii) platform motions.

2. The apparatus for aiming a gun of claim 1 wherein the gun is mounted on a turret and feedback controller means further includes means for processing sensory signals representative of turret azimuth and elevation data to generate actuation command signals to a turret azimuth actuator and elevation actuator.

3. The apparatus for aiming a gun of claim 1 wherein the actuator means of the at least one bending actuator assembly includes four actuator elements which are in quadrature with respect to each other thereby producing two pairs of bending torques about orthogonal axes normal to the gun barrel's longitudinal axis.

4. The apparatus for aiming a gun of claim 1 wherein the muzzle sensory means are accelerometer sensors.

5. The apparatus for aiming a gun of claim 1 wherein the muzzle sensory means are optical sensors.

6. The apparatus for aiming a gun of claim 3 wherein the at least one bending actuator assembly includes a means for displacement control of the bending actuator elements for precise displacement control of the actuator elements to linearize the response of the assembly for a desired input command to effectuate desired output torques of the gun barrel by the assembly.

7. The apparatus for aiming a gun of claim 2 wherein the feedback controller means is a linear based controller design.

8. The apparatus for aiming a gun of claim 7 wherein the linear based controller design is linear quadratic Gaussian/loop transfer recovery (LQG/LTR) controller.

9. The apparatus for aiming a gun of claim 7 wherein the linear based controller design is a disturbance accommodation controller.

10. The apparatus for aiming a gun of claim 7 wherein the linear based controller design is $H\infty$ (H-infinity).

11. The apparatus for aiming a gun of claim 2 wherein the feedback controller means is a nonlinear based controller design.

12. The apparatus for aiming a gun of claim 11 wherein the nonlinear based controller design is partial feedback linearization.

13. The apparatus for aiming a gun of claim 11 wherein the nonlinear based controller design is adaptive partial feedback linearization.

14. The apparatus for aiming a gun of claim 1 wherein the feedback controller means further includes a Kalman filter with Doppler radar muzzle velocity measurement sensors.

15. The apparatus for aiming a gun of claim 1 wherein the feedback controller means further includes a neural network with Doppler radar muzzle velocity measurement sensors.

* * * * *